US011227563B2

(12) United States Patent
Suzuki et al.

(10) Patent No.: US 11,227,563 B2
(45) Date of Patent: Jan. 18, 2022

(54) DEVICE AND METHOD FOR DRIVING A DISPLAY PANEL

(71) Applicant: Synaptics Incorporated, San Jose, CA (US)

(72) Inventors: Kentaro Suzuki, Tokyo (JP); Shigeru Ota, Tokyo (JP); Yoshitaka Iwasaki, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/909,758

(22) Filed: Jun. 23, 2020

(65) Prior Publication Data

US 2021/0027741 A1 Jan. 28, 2021

(30) Foreign Application Priority Data

Jul. 26, 2019 (JP) ..... JP2019-137636

(51) Int. Cl.
*G09G 5/395* (2006.01)
*G09G 5/00* (2006.01)

(52) U.S. Cl.
CPC ..... *G09G 5/003* (2013.01); *G09G 2360/18* (2013.01)

(58) Field of Classification Search
CPC ..... G09G 5/003; G09G 2360/18
See application file for complete search history.

(56) References Cited

U.S. PATENT DOCUMENTS

2006/0256033 A1* 11/2006 Chan ..... G09G 5/395 345/1.1
2009/0189848 A1* 7/2009 Maeda ..... G09G 3/344 345/107
2012/0194572 A1* 8/2012 Saitoh ..... G09G 5/06 345/690
2019/0198575 A1* 6/2019 Liu ..... H01L 27/326
2019/0347985 A1* 11/2019 Shaeffer ..... G09G 3/2003

* cited by examiner

*Primary Examiner* — Samantha (Yuehan) Wang
(74) *Attorney, Agent, or Firm* — Ferguson Braswell Fraser Kubasta PC

(57) ABSTRACT

A display driver chip includes interface circuitry, image data processing circuitry, and drive circuitry. The interface circuitry is configured to receive first frame image data for a first frame image. The image data processing circuitry includes a buffer memory configured to store at least part of the first frame image data. The image data processing circuitry is configured to supply, based on the at least part of the first frame image data stored in the buffer memory, first display data for a first display area of a plurality of display areas of a display panel having a zigzag pixel arrangement. The drive circuit is configured to drive a display element in the first display area based on the first display data.

20 Claims, 11 Drawing Sheets

DEVICE AND METHOD FOR DRIVING A DISPLAY PANEL

CROSS-REFERENCE TO RELATED APPLICATION

The present application claims the benefit of and priority to Japanese Patent Application Number 2019-137636, filed on Jul. 26, 2019, which is hereby incorporated by reference in its entirety.

FIELD

The disclosed technology generally relates to a display driver, display module and method for driving a display panel.

BACKGROUND

A display panel may be configured in a zigzag pixel arrangement in which rows of pixels in adjacent horizontal lines are located offset to each other. Meanwhile, a display panel, especially when in a large size, may be driven with a plurality of display drivers. In some cases, the plurality of display drivers may be adapted to a zigzag pixel arrangement.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes interface circuitry, image data processing circuitry, and drive circuitry. The interface circuitry is configured to receive first frame image data for a first frame image. The image data processing circuitry includes a buffer memory configured to store at least part of the first frame image data. The image data processing circuitry is configured to supply, based on the at least part of the first frame image data stored in the buffer memory, a first display data defined for a first display area of a plurality of display areas of a display panel having a zigzag pixel arrangement. The drive circuit is configured to drive a display element in the first display area based on the first display data.

In one or more embodiments, a display module is provided. The display module includes a display panel and a plurality of display drivers. The display panel has a zigzag pixel arrangement and includes a plurality of display areas. The plurality of display drivers is configured to drive the plurality of display areas, respectively. A first display driver of the plurality of display drivers includes first interface circuitry, first image data processing circuitry, and first drive circuitry. The first interface circuitry is configured to receive first frame image data for a first frame image. The first image data processing circuitry is configured to extract first image area image data defined for a first image area of the first frame image and first boundary image data from the first frame image data. The first boundary image data include pixel data defined for pixels located in a portion of a second image area adjacent to the first image area of the first frame image, the portion of the second image area being in contact with a boundary between the first image area and the second image area. The first image data processing circuitry is further configured to supply first display data based on the first image area image data and the first boundary image data. The drive circuitry is configured to drive a display element in a first display area of the plurality of display areas based on the first display data.

In one or more embodiments, a method for driving a display panel is provided.

The method includes: receiving, by a first display driver, first frame image data for a first frame image and extracting, by the first display driver, first image area image data and first boundary image data from the first frame image data. The first image area image data is defined for a first image area of the first frame image. The first boundary image data includes pixel data defined for pixels located in a portion of a second image area adjacent to the first image area of the first frame image, the portion being in contact with the first image area. The method further includes generating a first display data defined for a first display area of a plurality of display areas of a display panel having a zigzag pixel arrangement based on the first image area image data and the first boundary image data and driving, by the first display driver, a display element in the first display area based on the first display data.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
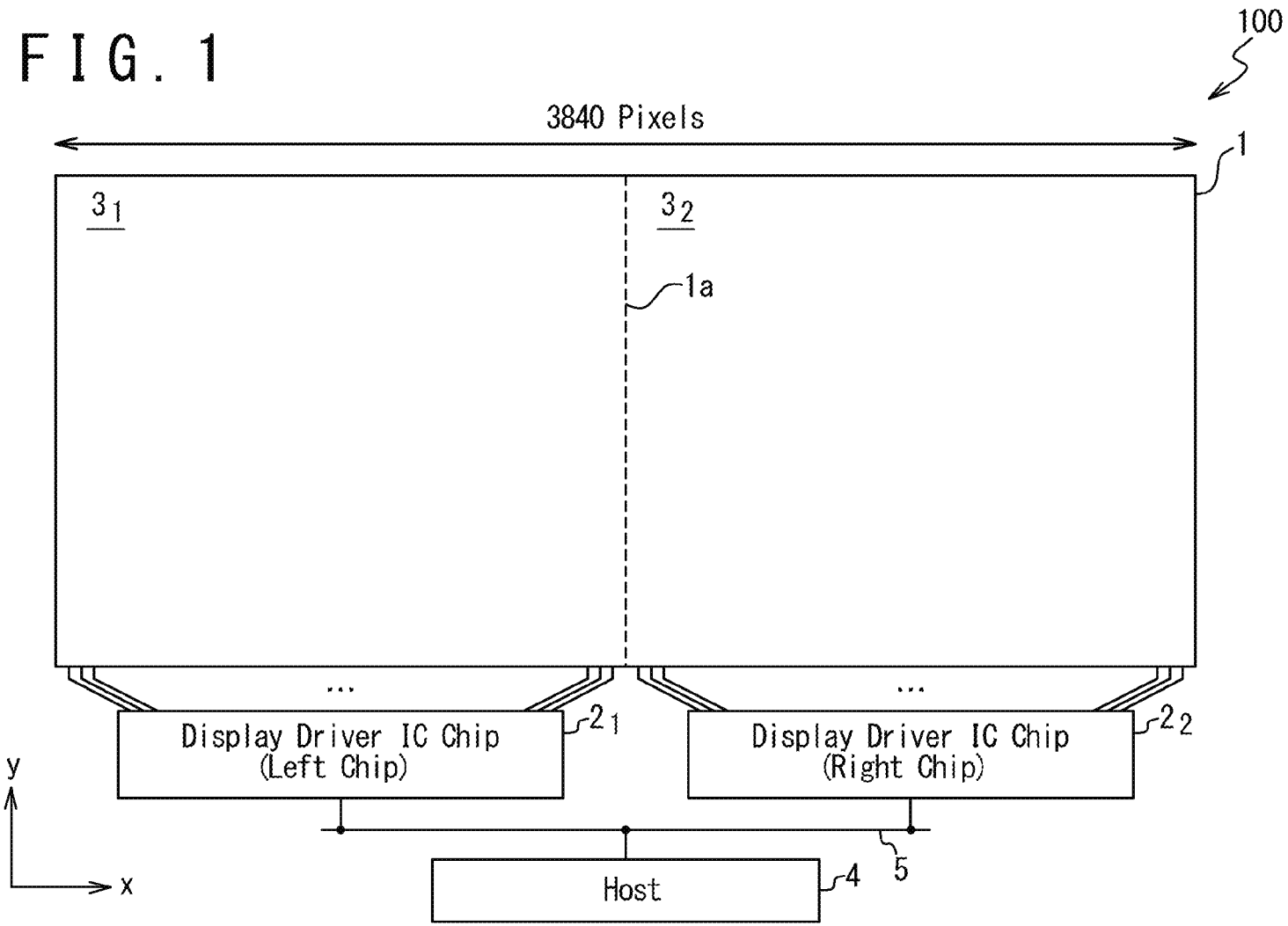
FIG. 1 illustrates an example configuration of a display module, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. Suffixes may be attached to reference numerals for distinguishing identical elements from each other. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

The present disclosure provides various schemes for driving a display panel configured in a zigzag pixel arrangement (which may be hereinafter simply referred to as zigzag display panel) with a plurality of display drivers (e.g., a plurality of display driver integrated circuit (DDIC) chips, a plurality of touch and display driver integrations (TDDI), and other devices configured to drive a display panel). In a zigzag display panel, rows of pixels in adjacent horizontal lines may be shifted from each other. In driving a zigzag display panel with a plurality of display drivers, image inconsistency may occur at a boundary between adjacent display areas that are driven by different display drivers.

To address the inconsistency at boundaries, a display driver may be configured to receive frame image data for a frame image and generate display data for a corresponding display area of a plurality of display areas of the display panel. In one implementation, the display driver may be configured to extract part of the frame image data for a corresponding image area and boundary image data from the frame image data. The boundary image data may include pixel data for pixels located in a portion of an adjacent image area of the frame image adjacent to the corresponding image area. The display driver may be configured to generate the display data based on the part of the frame image data for the corresponding image area and the boundary image data.

FIG. 1 illustrates an example configuration of a display module 100, according to one or more embodiments. In the illustrated embodiment, the display module 100 is configured to display a frame image with a horizontal resolution of 3840 pixels. The display module 100 includes a display panel 1 and a display drivers 2.

The display panel 1 may be segmented into a plurality of display areas 3 such that the number of the display areas 3 is identical to the number of the display drivers 2. In the illustrated embodiment, the number of the display drivers 2 is two, and the two display drivers 2 have the same configuration. The display area 3 includes a left area $\mathbf{3}_1$ and a right area $\mathbf{3}_2$, which are arrayed in the horizontal direction, which is indicated by the x axis of an xy coordinate system in FIG. 1. The left area $\mathbf{3}_1$ and the right area $\mathbf{3}_2$ are located adjacent to each other at a boundary 1*a* located at the center of the display panel 1. A left half of a frame image may be displayed in the left area $\mathbf{3}_1$ and a right half of the frame image may be displayed in the right area $\mathbf{3}_2$.

The display drivers 2 include a left chip $\mathbf{2}_1$ configured to drive display elements disposed in the left area $\mathbf{3}_1$ of the display panel 1 and a right chip $\mathbf{2}_2$ configured to drive display elements disposed in the right area $\mathbf{3}_2$.

The left chip $\mathbf{2}_1$ and right chip $\mathbf{2}_2$ may be configured to support multidrop communication with a host 4 via a bus 5. In various embodiments, frame image data for the entirety of a frame image may be sent to both the left chip $\mathbf{2}_1$ and right chip $\mathbf{2}_2$ using the multidrop communication. The frame image data may include pixel data for respective pixels of the frame image. In one implementation, pixel data for each pixel may include grayscale values of respective colors (e.g., red, green, and blue). The left chip $\mathbf{2}_1$ is configured to drive display elements disposed in the left area $\mathbf{3}_1$ based on the frame image data received from the host 4, and the right chip $\mathbf{2}_2$ is configured to drive display elements disposed in the right area $\mathbf{3}_2$ based on the frame image data.

Figure 2:
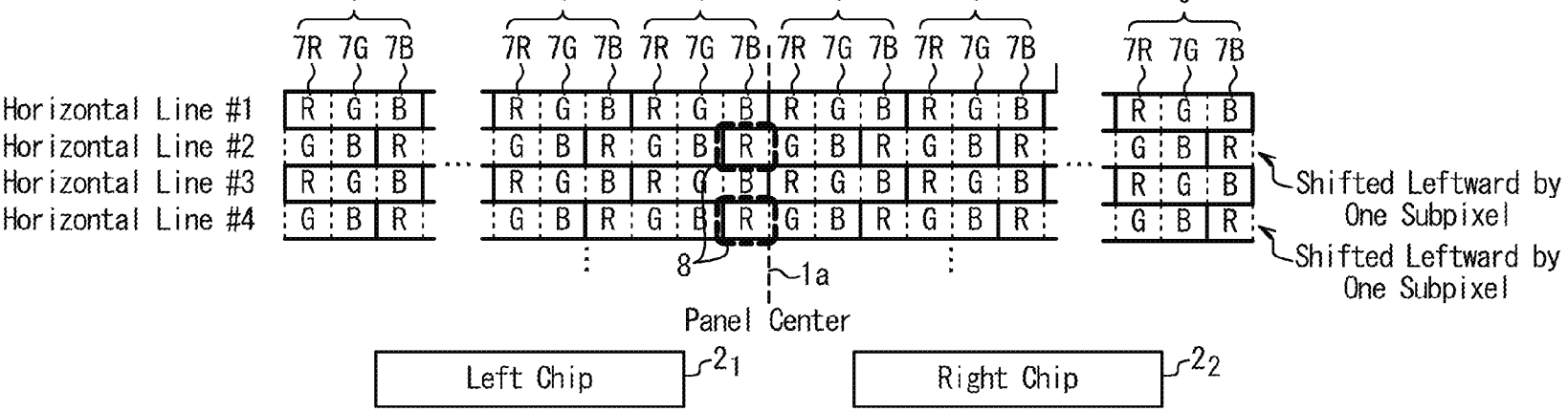
FIG. 2 illustrates an example configuration of a display panel, according to one or more embodiments.

FIG. 2 illustrates an exemplary pixel arrangement of the display panel 1, according to one or more embodiments. In the illustrated embodiment, a plurality of pixels 6 are arranged on the display panel 1. Each pixel 6 may include a red (R) subpixel 7R, a green (G) subpixel 7G, and a blue (B) subpixel 7B. In FIG. 2, the R subpixels 7R, the G subpixels 7G, and the B subpixels 7B are indicated by "R", "G", and "B", respectively. The R subpixels 7R, the G subpixels 7G, and the B subpixels 7B may be hereinafter collectively referred to as subpixels 7, if the colors of the subpixels 7 do not matter.

The R subpixels 7R, the G subpixels 7G, and the B subpixels 7B may include display elements configured to display red, green, and blue, respectively. In embodiments where the display panel 1 includes an organic light emitting diode (OLED) display panel, each display element may include a light emitting element, a select transistor, and a storage capacitor. In embodiments where the display panel 1 includes a liquid crystal display (LCD) panel, each display element may include a pixel electrode, a select transistor, and a storage capacitor. Each pixel 6 may additionally include one or more other subpixels 7 configured to display colors other than red, green, and blue.

In one or more embodiments, the display panel 1 is configured in a zigzag pixel arrangement. The display panel 1 may be configured such that pixels 6 in adjacent horizontal lines are shifted from each other. In the embodiment illustrated in FIG. 2, pixels 6 in even-numbered horizontal lines are shifted leftward from pixels 6 in odd-numbered horizontal lines by one subpixel 7.

Figure 3:
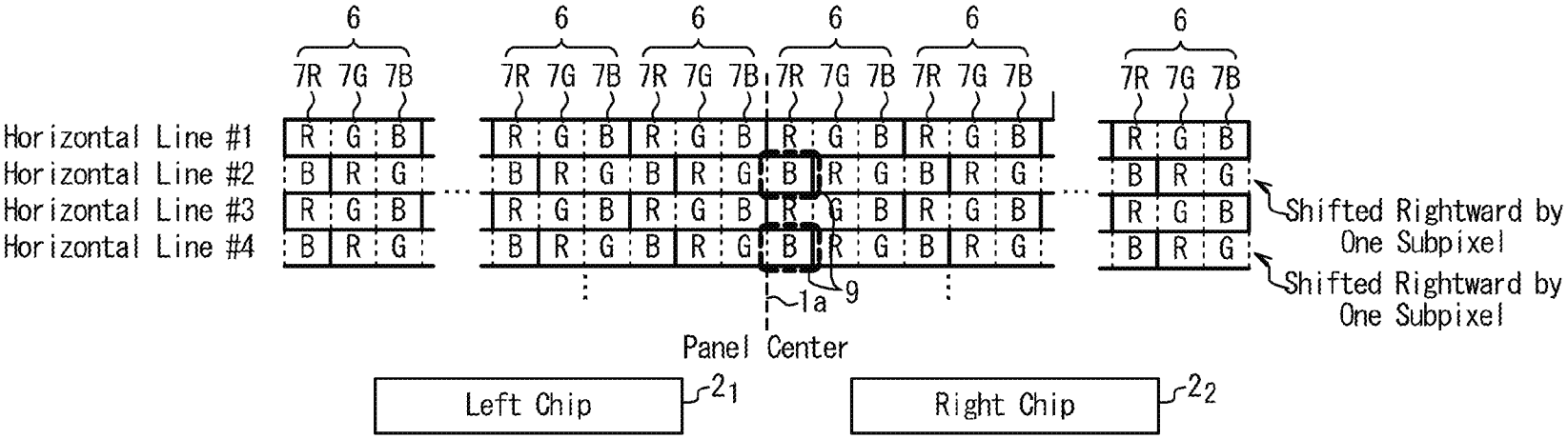
FIG. 3 illustrates an example configuration of a display panel, according to one or more embodiments.

The shift amount and/or direction of the pixels 6 may be variously modified. In other embodiments, as illustrated in FIG. 3, pixels 6 in even-numbered horizontal lines may be shifted rightward from pixels 6 in odd-numbered horizontal lines by one subpixel 7. In still other embodiments, the shift amount may be two subpixels 7 for both the cases of the leftward shift and the rightward shift.

In embodiments where the display panel 1 is configured in a zigzag pixel arrangement, a subpixel 7 located near the boundary 1*a* in the left area $\mathbf{3}_1$ may be driven based on pixel data for a pixel in a right half image area of the original frame image. In embodiments where a frame image is displayed in the display panel 1 illustrated in FIG. 2, for example, R subpixels 7R indicated by numerals "8" in even-numbered horizonal lines are driven based on grayscale values for red of pixel data for boundary pixels located in the right half image area of the original frame image, although they are actually located in the left area $\mathbf{3}_1$. The boundary pixels may be located in contact with the boundary between the right half image area and the left half image area.

In one or more embodiments, a subpixel 7 located near the boundary 1*a* in the right area $\mathbf{3}_2$ may be driven based on pixel data for a pixel in a left half image area of the original frame image. In embodiments where a frame image is displayed in the display panel 1 illustrated in FIG. 3, for example, B subpixels 7B indicated by numerals "9" in even-numbered horizonal lines are driven based on grayscale values for blue of pixel data for boundary pixels located in the left half image area of the original frame image, although they are actually located in the right area $3_2$. The boundary pixels may be located in contact with the boundary between the right half image area and the left half image area.

Figure 4:
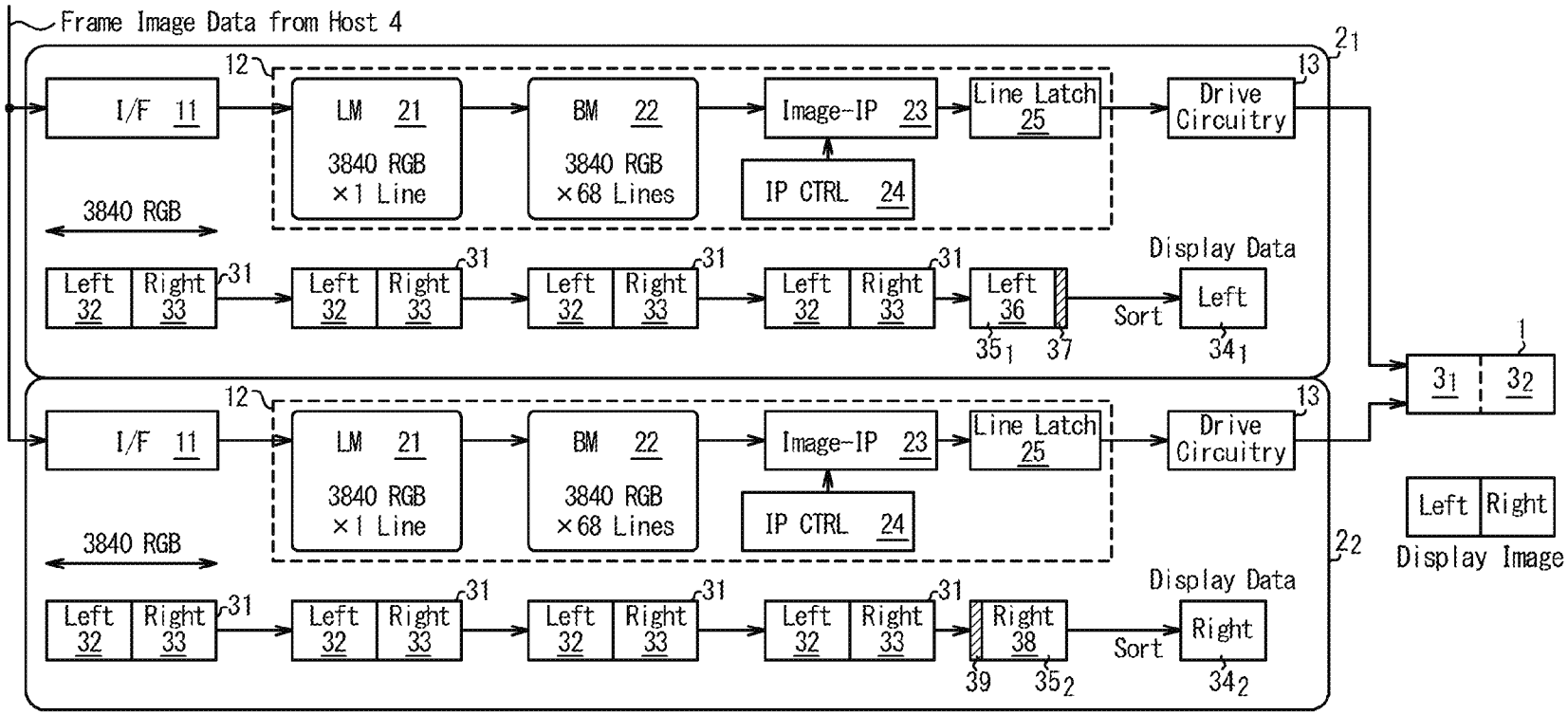
FIG. 4 illustrates an example configuration and operation of a display driver, according to one or more embodiments.

FIG. 4 illustrates example configurations of the left chip $2_1$ and the right chip $2_2$. In the illustrated embodiment, the left chip $2_1$ and the right chip $2_2$ have the same configuration. A display driver 2 may be configured to operate as any of the left chip $2_1$ and the right chip $2_2$. In one implementation, the display driver 2 is configured to operate as a left chip $2_1$ in a left operation mode and operate as a right chip $2_2$ in a right operation mode.

The left chip $2_1$ and the right chip $2_2$ each include interface circuitry 11, image data processing circuitry 12, and drive circuitry 13.

The interface circuitry 11 may be configured to receive frame image data 31 from the host 4 and forward the same to the image data processing circuitry 12. In one implementation, communications between the display drivers 2 and the host 4 may be achieved through low voltage differential signaling (LVDS), and the interface circuitry 11 may include an LVDS interface. In one or more embodiments, the frame image data 31 received by the interface circuitry 11 and forwarded to the image data processing circuitry 12 during a vertical sync period may include pixel data for all the pixels of one frame image. In other embodiments, the interface circuitry 11 may be configured to process frame image data received from the host 4 and use the processed frame image data as the frame image data 31 to be forwarded to the image data processing circuitry 12.

In one or more embodiments, the frame image data 31 includes left image data 32 and right image data 33. The left image data 32 may correspond to the left half image area of the frame image and include pixel data for pixels in the left half image area, where the pixel data may include grayscale values of the respective colors (e.g., red, green, and blue). The right image data 33 may correspond to the right half image area of the frame image and include grayscale values of the respective colors of pixels in the right half image area.

Left image data 32 for one horizontal line may include pixel data for pixels for half the horizontal resolution of the frame image. In embodiments where the horizontal resolution of the frame image is 3840 pixels, left image data 32 for one horizontal line may include pixel data for 1920 pixels. Right image data 33 for one horizontal line may include pixel data for pixels for half the horizontal resolution of the frame image, correspondingly. In embodiments where the horizontal resolution of the frame image is 3840 pixels, right image data 33 for one horizontal line may include pixel data for 1920 pixels.

In one or more embodiments, the image data processing circuitry 12 is configured to generate, based on the frame image data 31 received from the interface circuitry 11, display data 34 used to drive the display panel 1 by the drive circuitry 13. In FIG. 4, numeral $34_1$ denotes the display data 34 generated by the image data processing circuitry 12 of the left chip $2_1$, and numeral $34_2$ denotes the display data 34 generated by the image data processing circuitry 12 of the right chip $2_2$.

The drive circuitry 13 of the left chip $2_1$ is configured to drive the display elements in the left area $3_1$ of the display panel 1 in response to the display data $34_1$ received from the image data processing circuitry 12, and the drive circuitry 13 of the right chip $2_2$ is configured to drive the display elements in the right area $3_2$ of the display panel 1 in response to the display data $34_2$ received from the image data processing circuitry 12.

The image data processing circuitry 12 may include a line memory (LM) 21, a buffer memory (BM) 22, an image processing (IP) core 23, IP control circuitry 24, and a line latch 25.

The line memory 21 may be configured to store the frame image data 31 received from the interface circuitry 11 for one horizontal line. In embodiments where the horizontal resolution of the original frame image is 3840 pixels, the line memory 21 may have a capacity to store pixel data for 3840 pixels.

The buffer memory 22 is configured to sequentially receive and store the frame image data 31 from the line memory 21. The buffer memory 22 may be configured to store the frame image data 31 for multiple horizontal lines. In the embodiment illustrated in FIG. 4, the buffer memory 22 is configured to store the frame image data 31 for 68 horizontal lines. The buffer memory 22 may be configured to perform a first-in-first-out (FIFO) operation, outputting frame image data for the oldest horizontal line when newly receiving frame image data for one new horizontal line.

In one implementation, each of the left chip $2_1$ and the right chip $2_2$ may include a touch controller (not illustrated) for proximity sensing to sense an approach or contact of an input object to a touch panel. In such embodiments, the number of horizontal lines for which the buffer memory 22 is configured to store the frame image data 31 may be selected to provide sufficient time for the touch controller to achieve the proximity sensing in each vertical sync period.

The image processing IP core 23 is configured to process the frame image data 31 received from the buffer memory 22 to generate processed image data 35. In FIG. 4, numeral $35_1$ denotes the processed image data 35 generated by the image data processing circuitry 12 of the left chip $2_1$, and numeral $35_2$ denotes the processed image data 35 generated by the image data processing circuitry 12 of the right chip $2_2$. The processing performed by the image processing IP core 23 may be controlled by the IP control circuitry 24.

In one or more embodiments, the processed image data $35_1$ generated by the image processing IP core 23 of the left chip $2_1$ include processed left image data 36 and processed right boundary image data 37. The processed left image data 36 may be generated based on the left image data 32 of the frame image data 31. The processed left image data 36 may be generated by applying desired image processing to the left image data 32. In other embodiments, the left image data 32 extracted from the frame image data 31 may be used as the processed left image data 36 without modification. The processed right boundary image data 37 may be generated based on pixel data of the right image data 33 for the pixels located in a portion of the right half image area of the frame image, the portion being in contact with the boundary between the left half image area and the right half image area. In one embodiment, the processed right boundary image data 37 may be generated by extracting, from the right image data 33, pixel data for pixels in the portion of the right half image area of the frame image, the portion being in contact with the boundary between the left half image area and the right half image area, and applying image processing to the extracted pixel data. In other embodiments, the above-described pixel data extracted from the right image data 33 may be used as the processed right boundary image data 37 without modification.

In one or more embodiments, the processed image data $35_2$ generated by the image processing IP core 23 of the right chip $2_2$ includes processed right image data 38 and processed left boundary image data 39. The processed right image data 38 may be generated based on the right image data 33 of the frame image data 31. The processed right image data 38 may be generated by applying desired image processing to the right image data 33. In other embodiments, the right image data 33 extracted from the frame image data 31 may be used as the processed right image data 38 without modification. The processed left boundary image data 39 is generated based on pixel data of the left image data 32 for the pixels located in a portion of the left half image area of the frame image, the portion being in contact with the boundary between the left half image area and the right half image area. In one embodiment, the processed left boundary image data 39 may be generated by extracting, from the left image data 32, pixel data for pixels in the portion of the left half image area of the frame image, the portion being in contact with the boundary between the left half image area and the right half image area, and applying image processing to the extracted pixel data. In other embodiments, the above-described pixel data extracted from the left image data 32 may be used as the processed left boundary image data 39 without modification.

The line latches 25 may be configured to store the processed image data 35 for one horizontal line. In one implementation, the line latch 25 of the left chip $2_1$ is configured to store the processed image data $35_1$, and the line latch 25 of the right chip $2_2$ is configured to store the processed image data $35_2$. The line latches 25 are adapted to data transfer to the drive circuitry 13.

In one or more embodiments, data sorting is performed during the data transfer from the line latches 25 to the drive circuitry 13 to generate and supply display data 34 to the drive circuitry 13. The data sorting may be performed in accordance with the arrangement of the pixels 6 of the display panel 1. In one or more embodiments, part of the processed image data $35_1$ stored in the line latch 25 of the left chip $2_1$ and used to drive the display elements in the left area $3_1$ is selected in accordance with the arrangement of the pixels 6 of the display panel 1, and the selected part of the processed image data $35_1$ is transferred to the drive circuitry 13. In one implementation, the part of the processed image data $35_1$ thus transferred to the drive circuitry 13 is used as the display data $34_1$. In one or more embodiments, part of the processed image data $35_2$ stored in the line latch 25 of the right chip $2_2$ is correspondingly selected in accordance with the arrangement of the pixels 6 of the display panel 1, and the selected part to of the processed image data $35_2$ is transferred to the drive circuitry 13. In one implementation, the part of the processed image data $35_2$ thus transferred to the drive circuitry 13 is used as the display data $34_2$.

In one or more embodiments, the processed image data $35_1$ generated in the left chip $2_1$ includes the processed right boundary image data 37 for all the horizontal lines of the frame image, and the processed image data $35_2$ generated in the right chip $2_2$ includes the processed left boundary image data 39 for all the horizontal lines of the frame image. This enables generating the display data $34_1$ and $34_2$ adaptively to various arrangements of the pixels 6 of the display panel 1 by modifying the data sorting performed during the data transfer from the line latches 25 to the drive circuitry 13.

Figure 5:
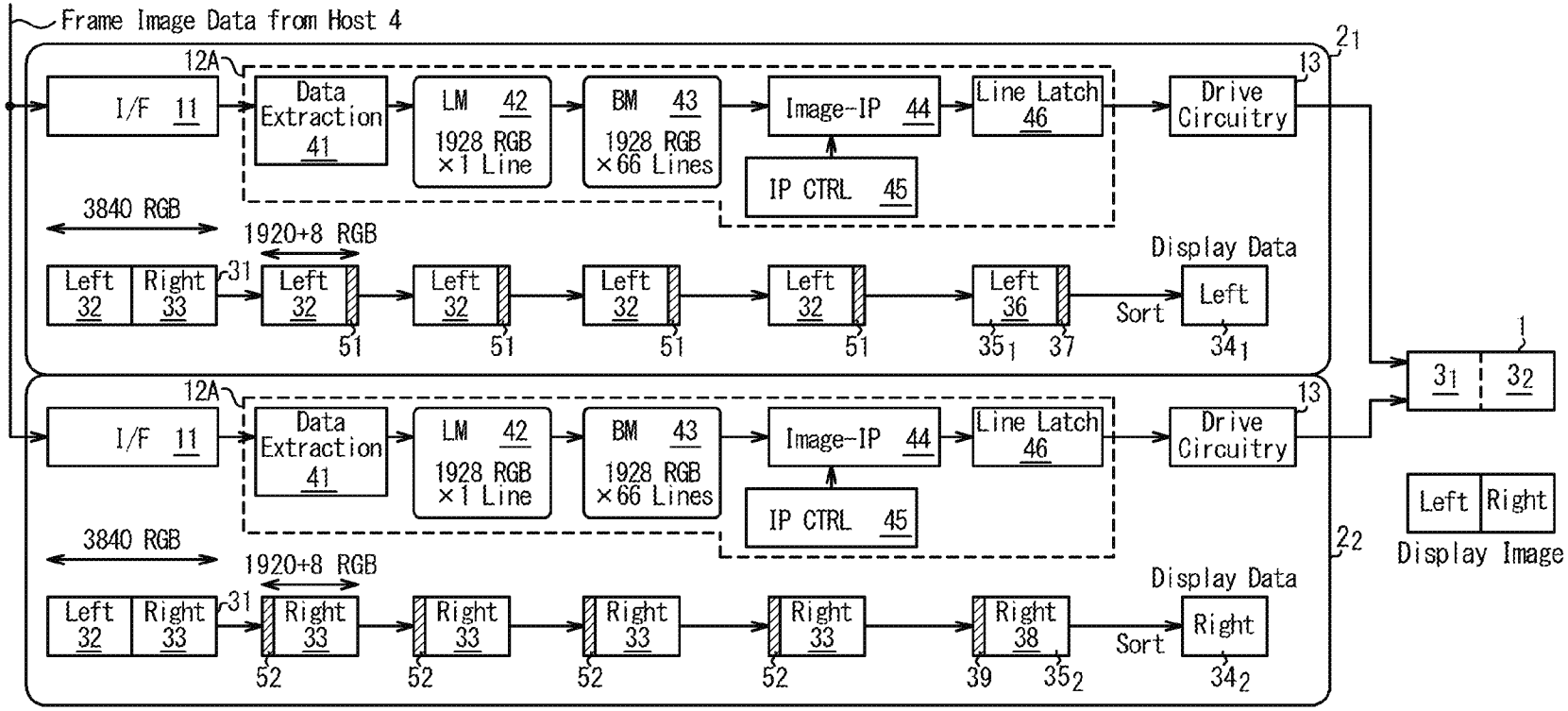
FIG. 5 illustrates an example configuration and operation of a display driver, according to one or more embodiments.

FIG. 5 illustrates an example configuration of display drivers 2 (including the left chip $2_1$ and the right chip $2_2$), according to other embodiments. In the illustrated embodiment, image data processing circuitry 12A of each display driver 2 includes data extraction circuitry 41, a line memory 42, a buffer memory 43, an image processing IP core 44, IP control circuitry 45 and a line latch 46.

In one or more embodiments, frame image data 31 received by the interface circuitry 11 during each vertical sync period include pixel data for all the pixels of one frame image, and the data extraction circuitry 41 is configured to extract pixel data to be stored in the line memory 42 and the buffer memory 43 from the frame image data 31 received from the interface circuitry 11. The extracted pixel data may be forwarded to the line memory 42.

The data extraction circuitry 41 of the left chip $2_1$ is configured to extract left image data 32 and right boundary image data 51 from the frame image data 31 received from the interface circuitry 11. The left image data 32 may correspond to the left half image area of the frame image and include grayscale values of the respective colors (e.g., red, green, and blue) of pixels in the left half image area. The right boundary image data 51 may include pixel data for pixels located in a portion of the right half image area of the frame image, the portion being in contact with the boundary between the left half image area and the right half image area. The extracted left image data 32 and the right boundary image data 51 may be forwarded to the line memory 42 of the left chip $2_1$.

The data extraction circuitry 41 of the right chip $2_2$ is configured to extract right image data 33 and left boundary image data 52 from the frame image data 31 received from the interface circuitry 11. The right image data 33 may correspond to the right half image area of the frame image and include grayscale values of the respective colors of pixels in the right half image area. The left boundary image data 52 may include pixel data for pixels located in a portion of the left half image area of the frame image, the portion being in contact with the boundary between the left half image area and the right half image area. The extracted right image data 33 and the left boundary image data 52 may be forwarded to the line memory 42 of the right chip $2_2$.

The right and left boundary image data 51 and 52 for one horizontal line may include pixel data for a number of pixels, the number being determined in accordance with image processing performed in the image processing IP cores 44. In one or more embodiment, the image processing IP cores 44 are each configured to perform image processing in units of blocks each consisting of a pixels located in the same horizontal line where a is a natural number of two or more, and the right and left boundary image data 51 and 52 for one horizontal line may each include pixel data for a pixels of one block. FIG. 5 illustrates the case where one block consists of eight pixels.

The line memory 42 of the left chip $2_1$ is configured to sequentially store the left image data 32 and the right boundary image data 51 received from the corresponding data extraction circuitry 41 and sequentially forward the same to the corresponding buffer memory 43. The line memory 42 of the right chip $2_2$ is configured to sequentially store the right image data 33 and the left boundary image data 52 received from the corresponding data extraction circuitry 41 and sequentially forward the same to the corresponding buffer memory 43.

Figure 6:
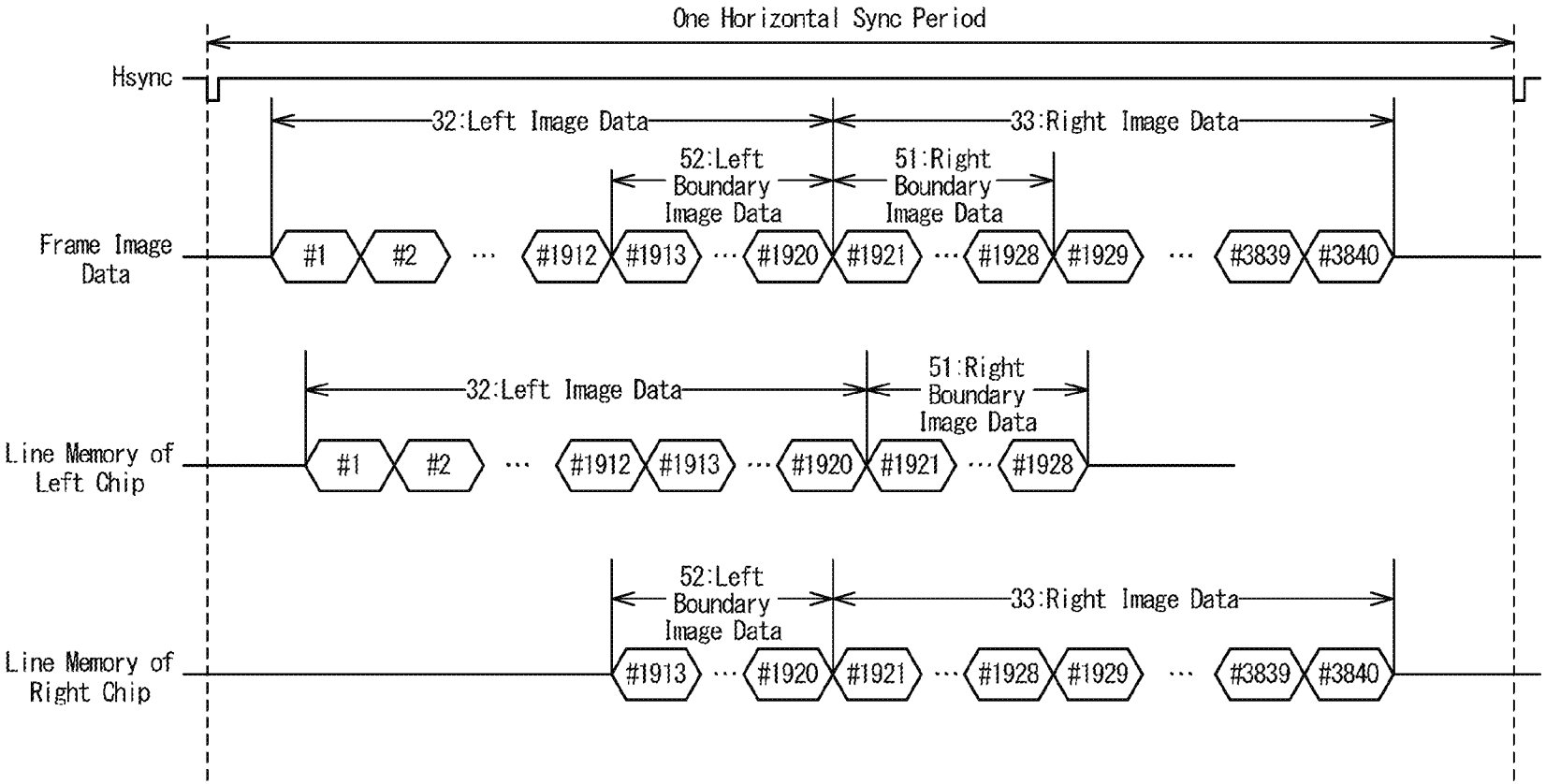
FIG. 6 illustrates an example operation of data extraction circuitry, according to one or more embodiments.

FIG. 6 illustrates an example operation of the data extraction circuitry 41, according to one or more embodiments. In the illustrated embodiment, after a horizontal sync period is initiated, pixel data of the frame image data 31 are sequentially transmitted to the interface circuitry 11 of the left and right chips $2_1$ and $2_2$ from the host 4. In FIG. 6, pixel data of the $i^{th}$ pixel of the frame image from the left is indicated by "#i." In embodiments where the horizonal resolution of the frame image is 3840 pixels, for example, pixel data #1 to #1920 of the left image data 32 are first sequentially transmitted to the interface circuitry 11, and then pixel data #1921 to #3840 of the right image data 33 are sequentially transmitted to the interface circuitry 11.

In one or more embodiments, the data extraction circuitry 41 of the left chip $\mathbf{2}_1$ is configured to extract pixel data #1 to #1920 as the left image data 32 and further extract pixel data #1921 to #1928 as the right boundary image data 51. The illustrated embodiment corresponds to the case where the image processing IP core 44 is configured to perform image processing in units of blocks each consisting of eight pixels located in the same horizontal line. The extracted left image data 32 and the right boundary image data 51 may be forwarded and stored in the line memory 42. The left image data 32 and the right boundary image data 51 stored in the line memory 42 may be forwarded to the buffer memory 43 in the next horizontal sync period.

In one or more embodiments, the data extraction circuitry 41 of the right chip $\mathbf{2}_2$ is configured to extract pixel data #1913 to #1920 as the left boundary image data 52 and further extract pixel data #1921 to #3840 as the right image data 33. The extracted left boundary image data 52 and the right image data 33 may be forwarded and stored in the line memory 42. The left boundary image data 52 and the right image data 33 stored in the line memory 42 may be forwarded to the buffer memory 43 in the next horizontal sync period.

The operation of the data extraction circuitry 41 illustrated in FIG. 6 enables driving the display panel 1 configured in the zigzag pixel arrangement, while contributing reduction in the capacities of the line memories 42 and the buffer memories 43.

Referring back to FIG. 5, the image processing IP core 44 of the left chip $\mathbf{2}_1$ may be configured to receive the left image data 32 and right boundary image data 51 from the buffer memory 43 and generate the processed image data $\mathbf{35}_1$ based on the received left image data 32 and right boundary image data 51. The processed image data $\mathbf{35}_1$ may include processed left image data 36 and processed right boundary image data 37. The processed left image data 36 may be generated based on the left image data 32 of the frame image data 31, and the processed right boundary image data 37 may be generated based on the right boundary image data 51. In some embodiments, the processed left image data 36 is generated by applying desired image processing to the left image data 32. In other embodiments, the left image data 32 may be used as the processed left image data 36 without modification. The processed right boundary image data 37 may be generated based on the right boundary image data 51. In some embodiments, the processed right boundary image data 37 may be generated by applying image processing to the right boundary image data 51. In other embodiments, the right boundary image data 51 may be used as the processed right boundary image data 37 without modification.

The image processing IP core 44 of the right chip $\mathbf{2}_2$ may be configured to receive the right image data 33 and left boundary image data 52 and generate the processed image data $\mathbf{35}_2$ based on the received right image data 33 and left boundary image data 52. The processed image data $\mathbf{35}_2$ may include processed right image data 38 and processed left boundary image data 39. The processed right image data 38 may be generated based on the right image data 33 of the frame image data 31, and the processed left boundary image data 39 may be generated based on the left boundary image data 52. In some embodiments, the processed right image data 38 is generated by applying desired image processing to the right image data 33. In other embodiments, the right image data 33 may be used as the processed right image data 38 without modification. The processed left boundary image data 39 may be generated based on the left boundary image data 52. In some embodiments, the processed left boundary image data 39 may be generated by applying image processing to the left boundary image data 52. In other embodiments, the left boundary image data 52 may be used as the processed left boundary image data 39 without modification.

In one or more embodiments, the image processing IP cores 44 of the left and right chips $\mathbf{2}_1$ and $\mathbf{2}_2$ are configured to exchange control data used for the image processing. The image processing IP core 44 of the left chip $\mathbf{2}_1$ may be configured to calculate a feature value of the left image area of the frame image (e.g., the average picture level (APL) of the left image area) based on the left image data 32 and send the calculated feature value to the image processing IP core 44 of the right chip $\mathbf{2}_2$. The image processing IP core 44 of the right chip $\mathbf{2}_2$ may be configured to calculate a feature value of the right image area of the frame image (e.g., the average picture level (APL) of the right image area) based on the right image data 33 and send the calculated feature value to the image processing IP core 44 of the left chip $\mathbf{2}_1$. The image processing IP core 44 of the left chip $\mathbf{2}_1$ may be configured to calculate a feature value of the entire frame image based on the feature value calculated by itself and the feature value calculated by the right chip $\mathbf{2}_2$ and perform the image processing based on the calculated feature value of the entire frame image. The image processing IP core 44 of the right chip $\mathbf{2}_2$ may be configured to calculate a feature value of the entire frame image based on the feature value calculated by itself and the feature value calculated by the left chip $\mathbf{2}_1$ and perform the image processing based on the calculated feature value of the entire frame image. This operation enables the image processing IP cores 44 of both the left and right chips $\mathbf{2}_1$ and $\mathbf{2}_2$ to perform the image processing based on the feature value of the entire frame image (e.g., the APL of the entire frame image).

In one implementation, the processed image data $\mathbf{35}_1$ and $\mathbf{35}_2$ are subjected to data transfer similar to the embodiment described in relation to FIG. 4 to supply the display data $\mathbf{34}_1$ and $\mathbf{34}_2$ to the drive circuitry 13. In one or more embodiments, data sorting is performed during this data transfer in accordance with the arrangement of the pixels 6 of the display panel 1. The drive circuitry 13 of the left chip $\mathbf{2}_1$ may be configured to drive the display elements in the left area $\mathbf{3}_1$ of the display panel 1 based on the display data $\mathbf{34}_1$ received from the corresponding image processing circuitry 12, and the drive circuitry 13 of the right chip $\mathbf{2}_2$ may be configured to drive the display elements in the right area $\mathbf{3}_2$ of the display panel 1 based on the display data $\mathbf{34}_2$ received from the corresponding image processing circuitry 12.

In various embodiments, a display driver 2 is configured to operate as the left chip $\mathbf{2}_1$ illustrated in FIG. 5 when placed in a left operation mode and operate as the right chip $\mathbf{2}_2$ when placed in a right operation mode.

Figure 7:
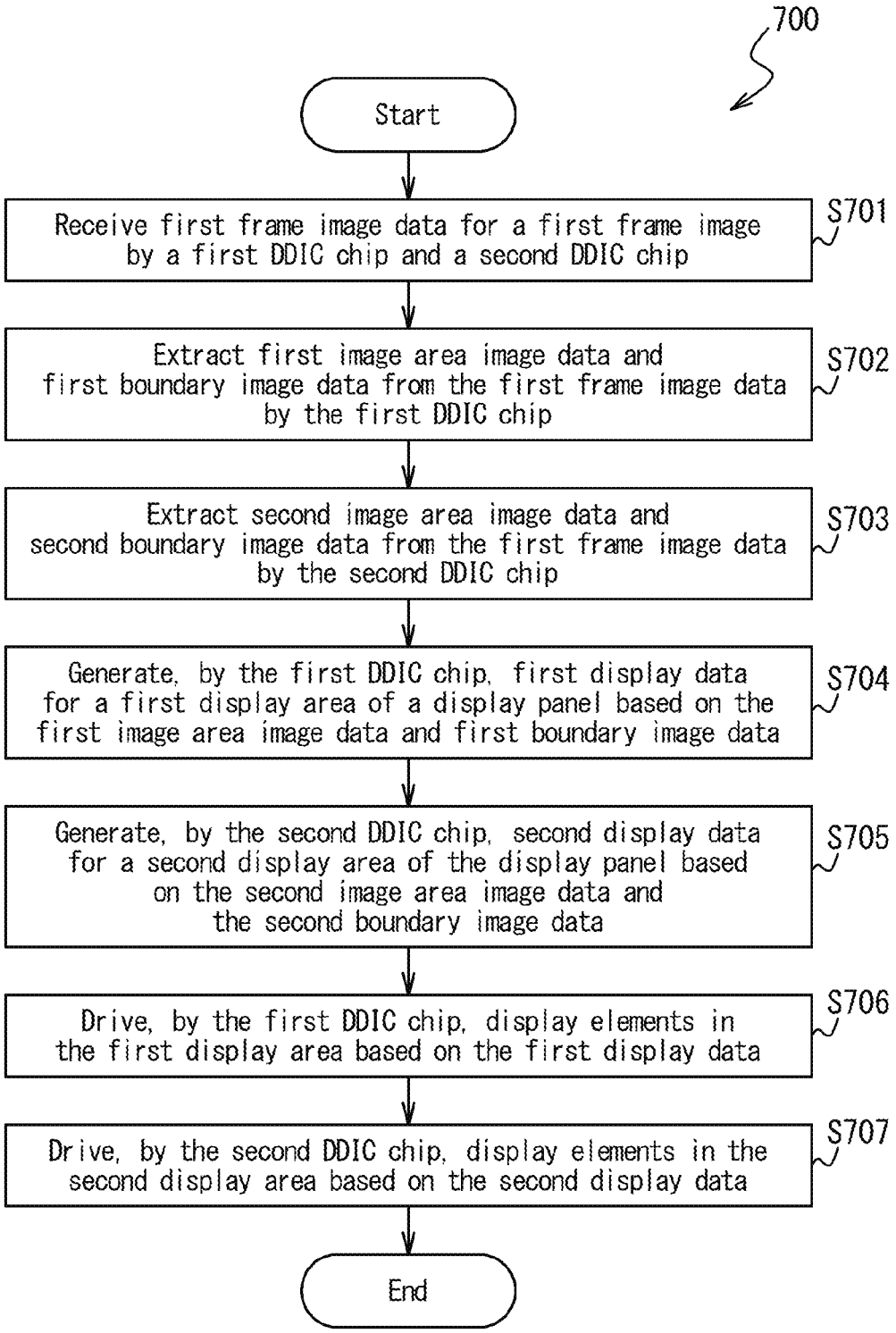
FIG. 7 illustrates a method for driving a display panel, according to one or more embodiments.

FIG. 7 is a flowchart illustrating method 700 in accordance with one or more embodiments. Method 700 may be executed by the display drivers 2. In one or more embodiments, one or more of the steps illustrated in FIG. 7 may be omitted, repeated, and/or performed in a different order than the order shown in FIG. 7.

In step 701, first and second display drivers 2 (e.g., the left chip $\mathbf{2}_1$ and the right chip $\mathbf{2}_2$) receive first frame image data for a first frame image (e.g., the frame image data 31.) In step 702, the first display driver 2 (e.g., the left chip $\mathbf{2}_1$)

extracts first image area image data and first boundary image data from the first frame image data. The first image area image data includes pixel data for pixels in a first image area (e.g., the left area $3_1$) of the display panel 1. In embodiments where the first image area is the left area $3_1$, the first image area image data may be or may include the left image data 32 defined for the left area $3_1$. The first boundary image data includes pixel data for boundary pixels located in a first portion of a second image area (e.g., the right area $3_2$) of the first frame image, where the second image area is adjacent to the first image area, and the first portion is located in contact with the boundary between the first image area and the second image area. In embodiments where the second image area is the right area $3_2$, the first boundary image data may be or may include the right boundary image data 51.

In step 703, the second display driver 2 (e.g., the right chip $2_2$) extracts second image area image data and second boundary image data from the first frame image data. The second image area image data includes pixel data for pixels in a second image area (e.g., the right area $3_2$) of the display panel 1. In embodiments where the second image area is the right area $3_2$, the second image area image data may be or may include the right image data 33 defined for the right area $3_2$. The second boundary image data includes pixel data for boundary pixels located in a second portion of the first image area (e.g., the left area $3_1$) of the first frame image, where the second portion is located in contact with the boundary between the first image area and the second image area. In embodiments where the first image area is the left area $3_1$, the second boundary image data may be or may include the left boundary image data 52.

In step 704, the first display driver 2 generates first display data (e.g., the display data $34_1$) based on the first image area image data and the first boundary image data. The first display driver 2 may generate processed first image area data (e.g., the processed left image data 36) and processed first boundary image data (e.g., the processed right boundary image data 37) by applying image processing to the first image area image data and the first boundary image data, respectively. The first display driver 2 may further generate the first display data based on the processed first image area data and the processed first boundary image data. The generation of the first display data may include data sorting or selection of the processed first image area data and the processed first boundary image data for each horizontal line.

In step 705, the second display driver 2 generate second display data (e.g., the display data $34_2$) based on the second image area image data and the second boundary image data. The second display driver 2 may generate processed second image area data (e.g., the processed right image data 38) and processed second boundary image data (e.g., the processed left boundary image data 39) by applying image processing to the second image area image data and the second boundary image data, respectively. The second display driver 2 may further generate the second display data based on the processed second image area data and the processed second boundary image data. The generation of the second display data may include data sorting or selection of the processed second image area data and the processed second boundary image data for each horizontal line.

In step 706, the first display driver 2 drives display elements in a first display area (e.g., the left area $3_1$) of the display panel 1 based on the first display data. In step 707, the second display driver 2 drives display elements in a second display area (e.g., the right area $3_2$) of the display panel 1 based on the second display data.

Figure 8:
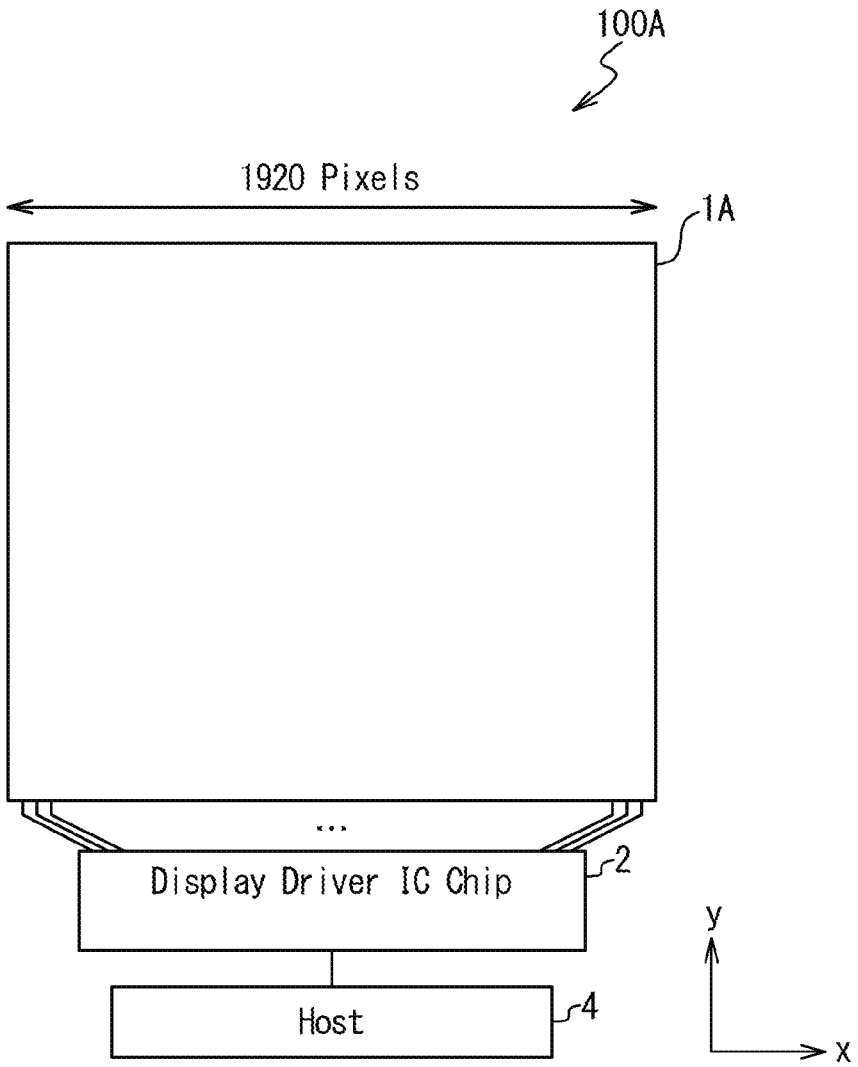
FIG. 8 illustrates an example configuration of a display module, according to one or more embodiments.

Referring to FIG. 8, the display driver 2 may further have an independent operation mode to drive a display panel 1A that has a horizontal resolution of one-half of the resolution of the display panel 1 illustrated in FIG. 1. In such embodiments, the display driver 2 can independently drive the display panel 1A in a display module 100A.

Figure 9:
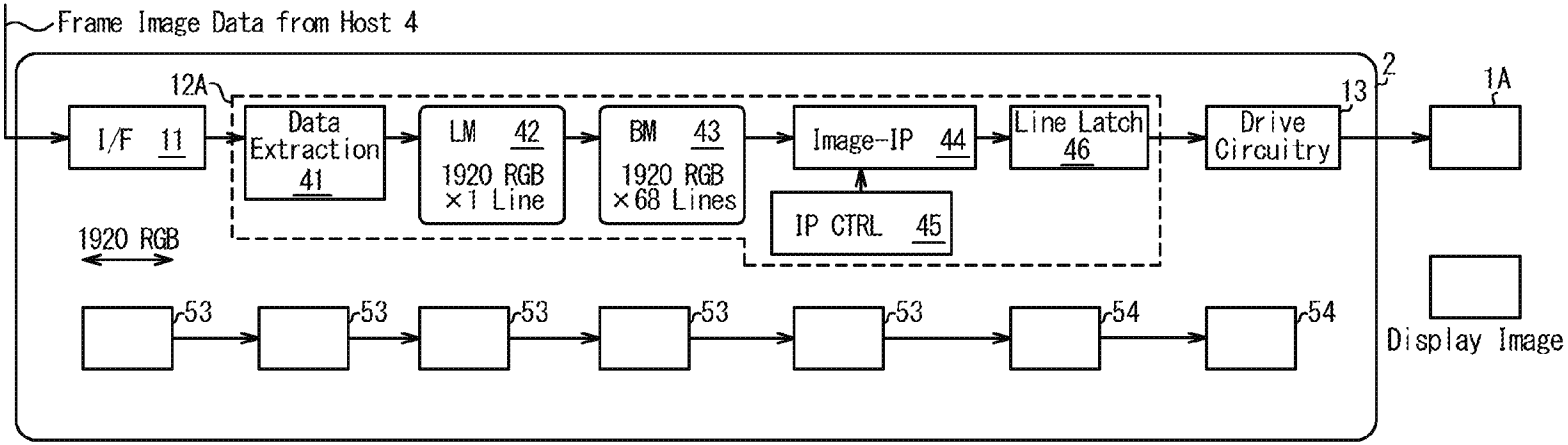
FIG. 9 illustrates an example operation of a display driver, according to one or more embodiments.

FIG. 9 illustrates an example operation of the display driver 2 in the independent operation mode. In the illustrated embodiment, when the display driver 2 is placed in the independent operation mode, the data extraction circuitry 41 stops operating, and the interface circuitry 11 sequentially forwards frame image data 53 received from the host 4 to the line memory 42 without modification. The frame image data 53 forwarded to the line memory 42 may be further forwarded and stored in the buffer memory 43. The image processing IP core 44 may receive the frame image data 53 from the buffer memory 43 and generate processed image data 54 by applying image processing to the received frame image data 53. The processed image data 54 may be forwarded to the line latch 46 and further to the drive circuitry 13. The drive circuitry 13 may drive the display elements of the display panel 1A based on the processed image data 54.

In one or more embodiments, when the display driver 2 is placed in the independent operation mode, the number of pixels for which pixel data are stored in the buffer memory 43 per horizontal line is reduced less than that for the case when the display driver 2 is placed in the left operation mode or the right operation mode. In some embodiments, the number of horizontal lines for which pixel data are stored in the buffer memory 43 is increased when the display driver IC chip 2 is placed in the independent operation mode. This operation is useful, for example, when a touch controller (not illustrated) is integrated in the display driver 2. Storing pixel data for an increased number of horizontal lines in the buffer memory 43 is useful for providing sufficient time for achieving proximity sensing by the touch controller in each vertical sync period.

In one implementation, when the DDIC IC chip 2 is placed in the left operation mode, left image data 32 and right boundary image data 51 for p horizontal lines may be stored in the buffer memory 43, where p is a natural number of two or more. In the embodiment illustrated in FIG. 5, p is 66. In various embodiments, p may be determined based on the capacity of the buffer memory 43 and/or the horizontal resolution. In embodiments where the left image data 32 for one horizontal line includes pixel data for 1920 pixels and the right boundary image data 51 for one horizontal line includes pixel data for eight pixels, the number of pixels for which the buffer memory 43 stores pixel data per horizontal line is 1928 in the left operation mode.

When the DDIC IC chip 2 is placed in the right operation mode, right image data 33 and left boundary image data 52 for p horizontal lines may be stored in the buffer memory 43. In embodiments where the right image data 33 for one horizontal line includes pixel data for 1920 pixels and the left boundary image data 52 for one horizontal line includes pixel data for eight pixels, the number of pixels for which the buffer memory 43 stores pixel data per horizontal line is 1928 also in the right operation mode.

When the DDIC IC chip 2 is placed in the independent operation mode, frame image data 53 for q horizontal lines may be stored in the buffer memory 43, where q is a natural number larger than p. In the embodiment illustrated in FIG. 9, q is 68. In embodiments where the frame image data 53 for one horizontal line includes pixel data for 1920 pixels, the number of pixels for which the buffer memory 43 stores pixel data per horizontal line is 1920 in the independent operation mode.

Figure 10:
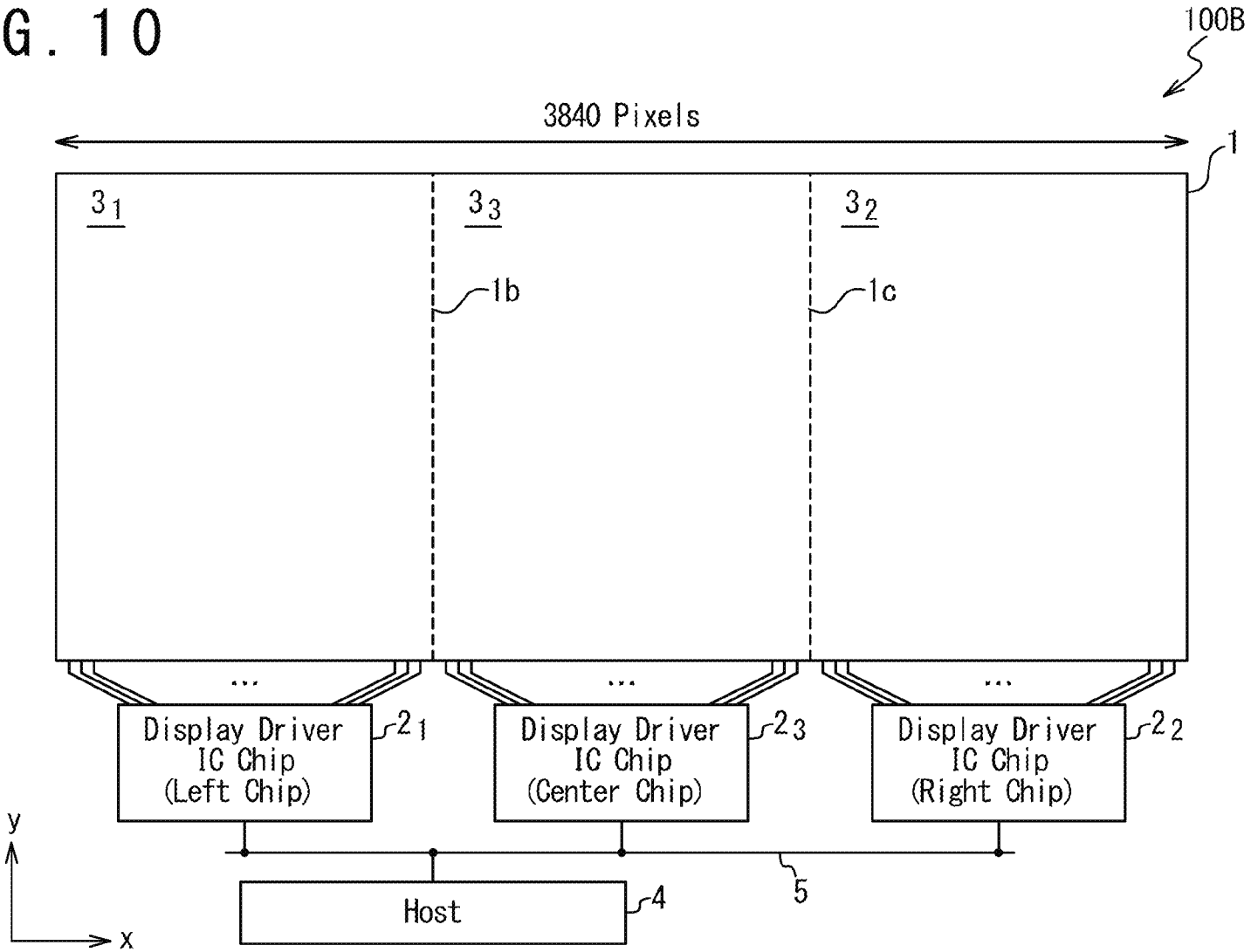
FIG. 10 illustrates an example configuration of a display module, according to one or more embodiments.

FIG. 10 illustrates an example configuration of a display module 100B, according to other embodiments. In the illustrated embodiment, the display module 100B includes a display panel 1 segmented into three display areas 3 arrayed in the horizontal direction and three display drivers 2 configured to drive the three display areas 3, respectively. The three display area 3 may include a left area $\mathbf{3}_1$, a right area $\mathbf{3}_2$, and a middle area $\mathbf{3}_3$. The left area $\mathbf{3}_1$ and the middle area $\mathbf{3}_3$ are adjacent across the boundary 1*b*, and the middle area $\mathbf{3}_3$ and the right area $\mathbf{3}_2$ are adjacent across the boundary 1*c*. The three DDIC 2 includes a left chip $\mathbf{2}_1$ configured to drive the left area $\mathbf{3}_1$, a right chip $\mathbf{2}_2$ configured to drive the right area $\mathbf{3}_2$, and a middle chip $\mathbf{2}_3$ configured to drive the middle area $\mathbf{3}_3$.

The left chip $\mathbf{2}_1$, the right chip $\mathbf{2}_2$, and the middle chip $\mathbf{2}_3$ may have the same configuration. Each display driver 2 may be configured to operate as the left chip $\mathbf{2}_1$, the right chip $\mathbf{2}_2$, and the middle chip $\mathbf{2}_3$, when placed in a left operation mode, a right operation mode, and a middle operation mode, respectively.

Figure 11:
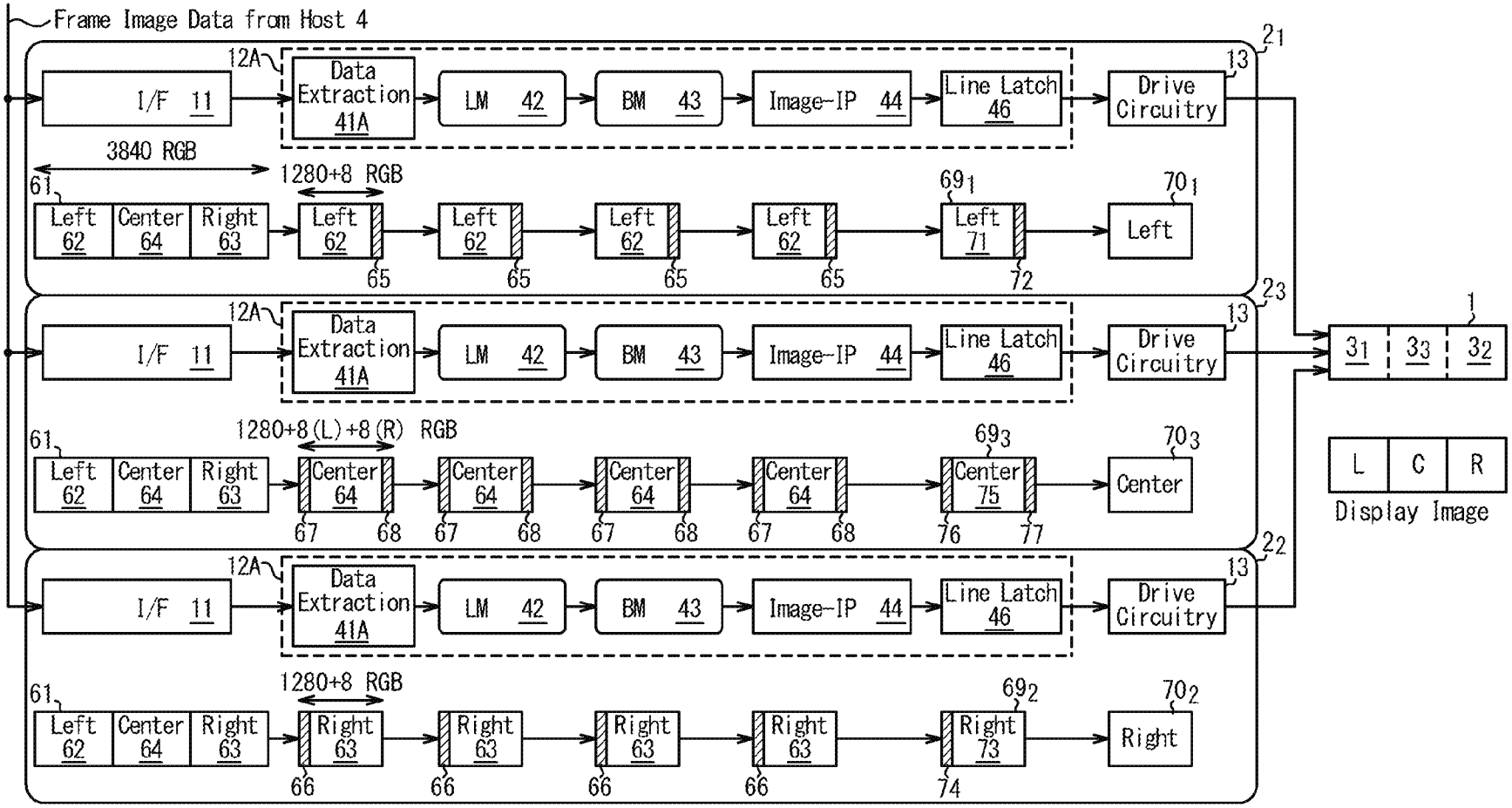
FIG. 11 illustrates an example configuration and operation of a display driver, according to one or more embodiments.

FIG. 11 illustrates an example configuration of the display drivers 2 of the display module 100B, according to one or more embodiments. In the illustrated embodiment, the image data processing circuitry 12A of each of the left chip $\mathbf{2}_1$, the right chip $\mathbf{2}_2$, and the middle chip $\mathbf{2}_3$ includes data extraction circuitry 41A, a line memory 42, a buffer memory 43, an image processing IP core 44, and a line latch 46.

In one or more embodiments, frame image data 61 received by the interface circuitry 11 of each display driver 2 during each vertical sync period includes pixel data for all the pixels of one frame image, and the data extraction circuitry 41A is configured to extract pixel data to be stored in the line memory 42 and the buffer memory 43 from the frame image data 61 received from the interface circuitry 11. The extracted pixel data may be forwarded to the line memory 42.

The frame image data 61 may include left image data 62 (which may be also referred to as first image area image data), right image data 63 (which may be also referred to as second image area image data), and middle image data 64 (which may be also referred to as second image area image data). The left image data 62 may be associated with or defined for the left image area (which may be also referred to as first image area) of the frame image and include pixel data for respective pixels in the left image area. The right image data 63 may be associated with or defined for a right image area (which may be also referred to as second image area) of the frame image and include grayscale values of respective colors of respective pixels in the right image area. The middle image data 64 may be associated with or defined for a middle image area (which may be also referred to as third image area) of the frame image and include grayscale values of respective colors of respective pixels in the middle image area.

Left image data 62 for one horizontal line may include pixel data for a number of pixels, the number being one-third of the horizontal resolution of the frame image. In one implementation, the horizontal resolution of the frame image is 3840 pixels, and the left image data 62 for one horizontal line includes pixel data for 1280 pixels. Correspondingly, right image data 63 and middle image data 64 for one horizontal line may each include pixel data for a number of pixels, the number being one-third of the horizontal resolution of the frame image. In one implementation, the right image data 63 and the middle image data 64 for one horizontal line include pixel data for 1280 pixels.

The data extraction circuitry 41A of the left chip $\mathbf{2}_1$ may be configured to extract the left image data 62 and first right boundary image data 65 from the frame image data 61 received from the interface circuitry 11. The first right boundary image data 65 may include pixel data for pixels located in a portion of the middle image area of the frame image, the portion being adjacent to the left image area. The left image data 62 and first right boundary image data 65 thus extracted may be forwarded to the line memory 42 in the left chip $\mathbf{2}_1$.

The data extraction circuitry 41A of the right chip $\mathbf{2}_2$ may be configured to extract the right image data 63 and first left boundary image data 66 from the frame image data 61 received from the interface circuitry 11. The first left boundary image data 66 may include pixel data for pixels located in a portion of the middle image area of the frame image, the portion being adjacent to the right image area. The right image data 63 and first left boundary image data 66 thus extracted may be forwarded to the line memory 42 in the right chip $\mathbf{2}_2$.

The data extraction circuitry 41A of the middle chip $\mathbf{2}_3$ may be configured to extract the middle image data 64, second left boundary image data 67, and second right boundary image data 68 from the frame image data 61 received from the interface circuitry 11. The second left boundary image data 67 may include pixel data for pixels located in a portion of the left image area of the frame image, the portion being adjacent to the middle image area. The second right boundary image data 68 may include pixel data for pixels located in a portion of the right image area of the frame image, the portion being adjacent to the middle image area. The middle image data 64, second left boundary image data 67 and second right boundary image data 68 thus extracted may be forwarded to the line memory 42 in the middle chip $\mathbf{2}_3$.

Such operation of the data extraction circuitry 41A enables driving the display panel 1 configured in the zigzag pixel arrangement, while contributing reduction in the capacities of the line memories 42 and the buffer memories 43.

The first right boundary image data 65, the first left boundary image data 66, the second left boundary image data 67, and the second right boundary image data 68 for one horizontal line may each include pixel data for a number of pixels, the number being determined based on image processing performed in the image processing IP cores 44. In one or more embodiment, the image processing IP cores 44 are each configured to perform image processing in units of blocks each consisting of a pixels located in the same horizontal line where a is a natural number of two or more, and the first right boundary image data 65, the first left boundary image data 66, the second left boundary image data 67, and the second right boundary image data 68 for one horizontal line may each include pixel data for a pixels of one block. FIG. 10 illustrates the case where one block consists of eight pixels.

The line memory 42 of the left chip $\mathbf{2}_1$ is configured to sequentially store the left image data 62 and the first right boundary image data 65 received from the corresponding data extraction circuitry 41A and sequentially forward the same to the corresponding buffer memory 43. The line memory 42 of the right chip $\mathbf{2}_2$ is configured to sequentially store the right image data 63 and the first left boundary image data 66 received from the corresponding data extraction circuitry 41A and sequentially forward the same to the corresponding buffer memory 43. The line memory 42 of the middle chip $2_3$ is configured to sequentially store the middle image data 64, the second left boundary image data 67, and the second right boundary image data 68 received from the corresponding data extraction circuitry 41A and sequentially forward the same to the corresponding buffer memory 43.

The image processing IP core 44 of the left chip $2_1$ may be configured to generate processed image data $69_1$ by applying desired processing to the left image data 62 and the first right boundary image data 65 received from the corresponding buffer memory 43. The processed image data $69_1$ may include processed left image data 71 and first processed right boundary image data 72. In one implementation, the image processing IP core 44 of the left chip $2_1$ may be configured to generate the processed left image data 71 and the first processed right boundary image data 72 by applying desired image processing to the left image data 62 and the first right boundary image data 65, respectively. The processed image data $69_1$ thus generated may be forwarded to the line latch 46 of the left chip $2_1$.

The image processing IP core 44 of the right chip $2_2$ may be configured to generate processed image data $69_2$ by applying desired processing to the right image data 63 and the first left boundary image data 66 received from the corresponding buffer memory 43. The processed image data $69_2$ may include processed right image data 73 and first processed left boundary image data 74. In one implementation, the image processing IP core 44 of the right chip $2_2$ may be configured to generate the processed right image data 73 and the first processed left boundary image data 74 by applying desired image processing to the right image data 63 and the first left boundary image data 66, respectively. The processed image data $69_2$ thus generated may be forwarded to the line latch 46 in the right chip $2_2$.

The image processing IP core 44 of the middle chip $2_3$ may be configured to generate processed image data $69_3$ by applying desired processing to the middle image data 64, the second left boundary image data 67, and the second right boundary image data 68 received from the buffer memory 43. The processed image data $69_3$ may include processed middle image data 75, second processed left boundary image data 76, and second processed right boundary image data 77. In one implementation, the image processing IP core 44 of the middle chip $2_3$ may be configured to generate the processed middle image data 75, the second processed left boundary image data 76, and the second processed right boundary image data 77 by applying desired image processing to the middle image data 64, the second left boundary image data 67, and the second right boundary image data 68, respectively. The processed image data $69_3$ thus generated may be forwarded to the line latch 46 of the middle chip $2_3$.

In one or more embodiments, the line latch 46 of each display driver 2 is adapted to data transfer to the corresponding drive circuitry 13. In one or more embodiments, data sorting is performed during the data transfer from the line latch 46 to the drive circuitry 13 to thereby supply display data 70 to the drive circuitry 13. The data sorting may be performed in accordance with the arrangement of the pixels 6 in the display panel 1.

In one implementation, display data used to drive the display elements in the left area $3_1$ may be selected from the processed image data $69_1$ stored in the line latch 46 of the left chip $2_1$ and transferred to the corresponding drive circuitry 13. The data transferred to the drive circuitry 13 of the left chip $2_1$ may be used as the display data $70_1$.

Correspondingly, display data used to drive the display elements in the right area $3_2$ may be selected from the processed image data $69_2$ stored in the line latch 46 of the right chip $2_2$ and transferred to the corresponding drive circuitry 13. The data transferred to the drive circuitry 13 of the right chip $2_2$ may be used as the display data $70_2$.

Further, display data used to drive the display elements in the middle area $3_3$ may be selected from the processed image data $69_3$ stored in the line latch 46 of the middle chip $2_3$ and transferred to the corresponding drive circuitry 13. The data transferred to the drive circuitry 13 of the middle chip $2_3$ may be used as the display data $70_3$.

In one or more embodiments, the drive circuitry 13 of the left chip $2_1$ is configured to drive the display elements in the left area $3_1$ of the display panel 1 based on the display data $70_1$; the drive circuitry 13 of the right chip $2_2$ is configured to drive the display elements in the right area $3_2$ of the display panel 1 based on the display data $70_2$; and the drive circuitry 13 of the middle chip $2_3$ is configured to drive the display elements in the middle area $3_3$ of the display panel 1 based on the display data $70_3$.

In other embodiments, the display panel 1 may be segmented into M display areas 3 and driven with M display drivers 2, where M is a natural number of three or more. In one implementation, the display driver 2 that drives the leftmost one of the M display areas 3 may be configured to operate similarly to the left chip $2_1$ described in relation to FIG. 10, and the display driver 2 that drives the rightmost one of the M display areas 3 may be configured to operate similarly to the right chip $2_2$ described in relation to FIG. 10. In such embodiments, the (M-2) display drivers 2 that drives the middle display area(s) 3 may be configured to operate similarly to the middle chip $2_3$ described in relation to FIG. 10.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

interface circuitry configured to receive first frame image data for a first frame image;

image data processing circuitry comprising a buffer memory configured to store at least part of the first frame image data, the image data processing circuitry configured to supply, based on the at least part of the first frame image data stored in the buffer memory, first display data for a first display area of a plurality of display areas of a display panel, the display panel comprising a plurality of pixels having a zigzag pixel arrangement, wherein each pixel of the plurality of pixels comprises a set of subpixels of a first type, a second type, and a third type, and wherein, in the zigzag pixel arrangement, the plurality of pixels is horizontally arranged in straight rows and vertically arranged in zigzagging columns in the display panel, with a physical horizontal offset between adjacent subpixels of the first type within each of the zigzagging columns; and drive circuitry configured to drive a subpixel of the first display area based on the first display data.

2. The display driver of claim 1, wherein the image data processing circuitry is configured to:

extract first image area image data and first boundary image data from the first frame image data, the first image area image data being defined for a first image area of the first frame image, the first boundary image data including pixel data for a first subset of the plurality of pixels located in a first portion of a second image area of the first frame image, the second image area adjacent to the first image area, and the first portion being in contact with a boundary between the first image area and the second image area; and supply the first display data to the drive circuitry based on the first image area image data and the first boundary image data stored in the buffer memory.

3. The display driver of claim 2, wherein the buffer memory is configured to store the first image area image data and the first boundary image data for a plurality of horizontal lines, and wherein the image data processing circuitry further comprises a line memory and is configured to:

sequentially store the first image area image data; and forward the first image area image data and the first boundary image data from the line memory to the buffer memory.

4. The display driver of claim 2, wherein the image processing circuitry is configured to:

generate processed first image area image data and processed first boundary image data by applying image processing to the first image area image data and the first boundary image data stored in the buffer memory, respectively; and supply the first display data to the drive circuitry based on the processed first image area image data and the processed first boundary image data.

5. The display driver of claim 4, wherein the first display data comprises image data selected from the processed first image area image data and the processed first boundary image data based on the zigzag pixel arrangement of the display panel.

6. The display driver of claim 4, wherein the image data processing circuitry is configured to generate the processed first image area image data and the processed first boundary image data by applying the image processing to the first image area image data and the first boundary image data in units of blocks each consisting of N pixels of the plurality of pixels, where N is a natural number of two or more, and wherein the first boundary image data comprises pixel data for N pixels of the plurality of pixels per horizontal line.

7. The display driver of claim 2, wherein the image data processing circuitry is configured to:

when the display driver is placed in a first operation mode, extract the first image area image data and the first boundary image data from the first frame image data;

store the first image area image data and the first boundary image data in the buffer memory; and supply the first display data to the drive circuitry based on the first image area image data and the first boundary image data stored in the buffer memory;

when the display driver is placed in a second operation mode, extract second image area image data for the second image area and second boundary image data from the first frame image data, the second boundary image data comprising pixel data for a second subset of the plurality of pixels located in a second portion of the first image area, the second portion being in contact with the boundary between the first image area and the second image area;

store the second image area image data and the second boundary image data in the buffer memory; and supply second display data for a second display area of the plurality of display areas to the drive circuitry based on the second image area image data and the second boundary image data stored in the buffer memory.

8. The display driver of claim 1, wherein a number of the plurality of display areas is three or more, wherein the image data processing circuitry is configured to:

when the display driver is placed in a first operation mode, extract first image area image data and first boundary image data from the first frame image data, the first image area image data comprising pixel data for a first image area located at an end of the first frame image, the first boundary image data comprising pixel data for a first portion of an adjacent image area adjacent to the first image area, in the first frame image, the first portion being in contact with a boundary between the adjacent image area and the first image area;

store the first image area image data and the first boundary image data into the buffer memory; and supply the first display data to the drive circuitry based on the first image area image data and the first boundary image data stored in the buffer memory; and when the display driver is placed in a second operation mode, extract second image area image data, second boundary image data, and third boundary image data from the first frame image data, the second image area image data comprising pixel data for a second image area located in a middle of the first frame image, the second boundary image data comprising pixel data for a second subset of the plurality of pixels located in a second portion of a third image area of the first frame image adjacent to the second image area, the second portion being in contact with a boundary between the second image area and the third image area, and the third boundary image data comprising pixel data for a third subset of the plurality of pixels located in a third portion of a fourth image area of the first frame image adjacent to the second image area on an opposite side of the third image area, the third portion being in contact with a boundary between the second image area and the fourth image area;

store the second image area image data, the second boundary image data, and the third boundary image data into the buffer memory; and supply second display data for a second display area of the plurality of display areas to the drive circuitry based on the second image area image data and the second boundary image data, and the third boundary image data stored in the buffer memory.

9. The display driver of claim 1, wherein the image data processing circuitry is configured to:

generate processed first image area image data and processed first boundary image data based on the at least part of the first frame image data, the processed first image area image data comprising pixel data for a first subset of the plurality of pixels located in a first image area of the first frame image, and the processed first boundary image data comprising pixel data for a second subset of the plurality of pixels located in a portion of a second image area of the first frame image, the second image area adjacent to the first image area, the portion being in contact with a boundary between the first image area and the second image area; and supply the first display data to the drive circuitry based on the processed first image area image data and the processed first boundary image data.

10. The display driver of claim 9, wherein the first display data comprises image data selected from the processed first image area image data and the processed first boundary image data based on the zigzag pixel arrangement of the display panel.

11. The display driver of claim 9, wherein the processed first boundary image data are generated for all the horizontal lines of the first frame image.

12. A display driver, comprising:

interface circuitry configured to receive first frame image data for a first frame image, wherein the first image frame has a first horizontal resolution;

image data processing circuitry comprising a buffer memory configured to store at least part of the first frame image data, the image data processing circuitry configured to:

supply, based on the at least part of the first frame image data stored in the buffer memory, first display data for a first display area of a plurality of display areas of a first display panel, the first display panel having a zigzag pixel arrangement, and when the display driver is placed in an individual operation mode to display a second frame image of a second horizonal resolution of one-half of the first horizontal resolution of the first frame image, receive second frame image data for the second frame image, when the display driver is placed in the individual operation mode, store the entirety of the second frame image data received by the interface circuitry into the buffer memory; and drive circuitry configured to:

drive a display element of the first display area based on the first display data, and when the display driver is placed in the individual operation mode, drive a second display panel based on the second frame image data stored in the buffer memory.

13. The display driver of claim 12, wherein the buffer memory is configured to:

when the display driver is placed in a first operation mode, store the first image area image data and the first boundary image data for p horizontal lines, where p is a natural number of two or more, when the display driver is placed in the individual operation mode, store the second frame image data for q horizontal lines, where q is a natural number more than p.

14. A display module, comprising:

a display panel comprising a plurality of pixels having a zigzag pixel arrangement, wherein each pixel of the plurality of pixels comprises a set of subpixels of a first type, a second type, and a third type, and wherein, in the zigzag pixel arrangement, the plurality of pixels is horizontally arranged in straight rows and vertically arranged in zigzagging columns in the display panel, with a physical horizontal offset between adjacent subpixels of the first type within each of the zigzagging columns, the display panel comprising a plurality of display areas; and a plurality of display drivers configured to drive the plurality of display areas, wherein a first display driver of the plurality of display drivers comprises:

first interface circuitry configured to receive first frame image data for a first frame image;

first image data processing circuitry configured to:

extract first image area image data and first boundary image data from the first frame image data, the first image area image data being defined for a first image area of the first frame image, the first boundary image data including pixel data for a subset of the plurality of pixels located in a first portion of a second image area of the first frame image, the second image area adjacent to the first image area, and the first portion being in contact with a boundary between the first image area and the second image area; and supply first display data based on the first image area image data and the first boundary image data; and first drive circuitry configured to drive a subpixel of a first display area of the plurality of the display areas based on the first display data.

15. The display module of claim 14, wherein a second display driver of the plurality of display drivers comprises:

second interface circuitry configured to receive the first frame image data;

second image data processing circuitry configured to:

extract second image area image data and second boundary image data from the first frame image data, the second image area image data being defined for the second image area, the second boundary image data including pixel data for a second subset of the plurality of pixels located in a second portion of the first image area, and the second portion being in contact with the boundary between the first image area and the second image area; and supply second display data based on the second image area image data and the second boundary image data; and second drive circuitry configured to drive a subpixel of a second display area of the plurality of display areas based on the second display data.

16. The display module of claim 15, wherein the plurality of display drivers has a same configuration, wherein one of the plurality of the display drivers which is placed in a first operation mode operates as the first display driver, and wherein a different one of the plurality of the display drivers which is placed in a second operation mode operates as the second display driver.

17. The display module of claim 14, wherein the first image data processing circuitry is configured to generate processed first image area image data and processed first boundary image data by applying image processing to the first image area image data and the first boundary image data in units of blocks each comprising N pixels of the plurality of pixels, where N is an integer of two or more, and wherein the first boundary image data comprises pixel data for N pixels of the plurality of pixels per horizontal line.

18. A method for driving a display panel comprising a plurality of pixels, the method comprising:

receiving first frame image data for a first frame image by a first display driver, extracting, by the first display driver, first image area image data and first boundary image data from the first frame image data, the first image area image data being defined for a first image area of the first frame image, the first boundary image data including pixel data for pixels of the plurality of pixels located in a first portion of a second image area of the first frame image adjacent to the first image area, and the first portion being in contact with a boundary between the first image area and the second image area;

generating, by the first display driver, first display data for a first display area of a plurality of display areas of the display panel based on the first image area image data and the first boundary image data, wherein each pixel of the plurality of pixels comprises a set of subpixels of a first type, a second type, and a third type, wherein the plurality of pixels in the display panel has a zigzag pixel arrangement, and wherein, in the zigzag pixel arrangement, the plurality of pixels is horizontally arranged in straight rows and vertically arranged in zigzagging columns in the display panel, with a physical horizontal offset between adjacent subpixels of the first type within each of the zigzagging columns; and driving, by the first display driver, a subpixel in the first display area based on the first display data.

19. The method of claim 18, further comprising:

receiving the first frame image data by a second display driver, extracting, by the second display driver, second image area image data and second boundary image data from the first frame image data, the second image area image data being defined for the second image area of the first frame image, the second boundary image data including pixel data for pixels located in a second portion of the first image area, and the second portion being in contact with the boundary between the first image area and the second image area;

generating, by the second display driver, second display data for a second display area of the plurality of display areas based on the second image area image data and the second boundary image data; and driving, by the second display driver, a subpixel in the second display area based on the second display data.

20. The method of claim 19, wherein the first display driver and the second display driver have a same configuration.

* * * * *